US010926851B2

(12) United States Patent
Choi et al.

(10) Patent No.: US 10,926,851 B2
(45) Date of Patent: Feb. 23, 2021

(54) LIGHTWEIGHT COMPOSITE PROPELLERS FOR OUTBOARD MOTOR

(71) Applicant: XINNOS CO., LTD., Yeongam-gun (KR)

(72) Inventors: Yang Ryul Choi, Seoul (KR); Tae In Cha, Seoul (KR); Jae Hoon Jung, Seoul (KR)

(73) Assignee: XINNOS CO., LTD., Yeongam-gun (KR)

( * ) Notice: Subject to any disclaimer, the term of this patent is extended or adjusted under 35 U.S.C. 154(b) by 364 days.

(21) Appl. No.: 16/079,981

(22) PCT Filed: May 16, 2017

(86) PCT No.: PCT/KR2017/005045
§ 371 (c)(1),
(2) Date: Aug. 24, 2018

(87) PCT Pub. No.: WO2017/200256
PCT Pub. Date: Nov. 23, 2017

(65) Prior Publication Data

US 2019/0061892 A1 Feb. 28, 2019

(30) Foreign Application Priority Data

May 18, 2016 (KR) ..... 20-2016-0002722

(51) Int. Cl.

| | |
|---|---|
| ***B63H 1/20*** | (2006.01) |
| ***B63H 1/26*** | (2006.01) |
| ***F01D 5/28*** | (2006.01) |
| *B63H 5/07* | (2006.01) |
| *B63H 23/34* | (2006.01) |
| *F04D 29/34* | (2006.01) |

(52) U.S. Cl.
CPC ..... *B63H 1/26* (2013.01); *B63H 1/20* (2013.01); *F01D 5/282* (2013.01); *B63B 2231/10* (2013.01); *B63B 2231/40* (2013.01); *B63H 5/07* (2013.01); *B63H 23/34* (2013.01); *F04D 29/34* (2013.01)

(58) Field of Classification Search
CPC ... B63H 1/20; B63H 1/26; B63H 1/00; B63H 1/12; B63H 1/14; B63H 1/18; B63H 5/07; B63H 5/10; B63H 23/34; B63H 2023/342; F04D 29/34; F01D 5/30; F01D 5/3007
USPC ..... 441/79, 80, 83, 49, 50
See application file for complete search history.

(56) References Cited

U.S. PATENT DOCUMENTS 3,246,699 A * 4/1966 Jocz ..... B63H 1/26 416/215
4,930,987 A * 6/1990 Stahl ..... B63H 1/20 416/219 A (Continued)

OTHER PUBLICATIONS

International Search Report for International Patent Application No. PCT/KR2017/005045, dated Aug. 22, 2017.

*Primary Examiner* — Brian P Wolcott
*Assistant Examiner* — Behnoush Haghighian

(57) ABSTRACT

The present invention relates to a lightweight composite propeller for an outboard motor, wherein the propeller has a separate hub and blades which are easily repaired when damaged, improves fuel efficiency because a lightweight composite material is used therefor, and is easily manufactured in large quantities.

5 Claims, 5 Drawing Sheets

(56) References Cited

U.S. PATENT DOCUMENTS

| | | | | |
|---|---|---|---|---|
| 5,354,177 | A * | 10/1994 | Chang | F04D 29/34 416/219 A |
| 6,471,481 | B2 * | 10/2002 | Chen | B63H 1/20 416/134 R |
| 6,685,432 | B2 * | 2/2004 | Chen | B63H 1/20 416/134 R |
| 7,056,092 | B2 * | 6/2006 | Stahl | B63H 1/14 416/129 |
| 8,235,666 | B2 * | 8/2012 | Rosenkranz | B63H 3/04 416/155 |
| 9,039,378 | B2 * | 5/2015 | Ulgen | B63H 1/26 416/212 R |
| 9,133,856 | B2 * | 9/2015 | Wang | F04D 29/34 |
| 9,550,555 | B2 * | 1/2017 | Ulgen | B63H 1/20 |
| 9,944,372 | B1 * | 4/2018 | Stahl | B63H 1/26 |
| 2002/0085914 | A1 * | 7/2002 | Chen | B63H 23/34 416/134 R |
| 2003/0012652 | A1 * | 1/2003 | Chen | B63H 1/20 416/134 R |
| 2005/0226724 | A1 * | 10/2005 | Stahl | B63H 5/10 416/93 A |
| 2008/0166933 | A1 * | 7/2008 | Rosenkranz | B63H 3/04 440/50 |
| 2010/0189563 | A1 * | 7/2010 | Gonz Lez Abal | B63H 1/20 416/219 R |

* cited by examiner

LIGHTWEIGHT COMPOSITE PROPELLERS FOR OUTBOARD MOTOR

CROSS-REFERENCE TO RELATED APPLICATIONS

The present specification is a U.S. National Stage of International Patent Application No. PCT/KR2017/005045 filed May 16, 2017, which claims priority to and the benefit of Korean Patent Application No. 20-2016-0002722 filed in the Korean Intellectual Property Office on May 18, 2018, the entire contents of which are incorporated herein by reference.

TECHNICAL FIELD

The present invention relates to a lightweight composite propeller for an outboard motor.

BACKGROUND ART

An outboard motor is a propulsion system that is mounted at the rear of a vessel such as a small boat and vessels can be propelled by the outboard motor. Outboard motors are usually mounted at the stern of vessels, but are mounted on small boats other than rubber boats.

Since an outboard motor is a propulsion system, outboard motors are manufactured separately from vessels. That is, an outboard motor uses an internal combustion engine, but is very different in structure and strokes from those of vehicle or motorcycles, so the manufacturer of outboard motors may be different from the manufactures of vessels.

Companies of foreign countries including Japan, have most technologies related to outboard motors, so the outboard motors that are presently on the market are unavoidably all imported. The outboard motors are complicated propulsion systems in terms of structure and are imported products, so outboard motors of 2 hp are expensive around 1.5 million Won. Accordingly, purchase of such a motor is large burden on the people who enjoy ocean sports. Further, despite of being expensive products, the outboard motors that are at present on the market are complicated in structure and sellers of outboard motors are very limited, so outboard motors are expensive and time consuming to use and maintain. Accordingly, it is urgent to develop a domestically-made outboard motor to solve this problem.

Meanwhile, the propellers for outboard motors are also imported, and expensive non-metals are used for the propellers of outboard motors to maximize anticorrosion and strength, so the propellers are heavy and difficult to manufacture in large quantities through precision casing. Further, if the propellers are damaged, their power is reduced, vibration is generated, and welding is required for repair thereof, so repair is expensive and time-consuming. Further, if the propellers are severely damaged, the entire propeller should be replaced, which is costly.

DISCLOSURE

Technical Problem

The present invention has been made in an effort to solve the problems and an object of the present invention is to provide a lightweight composite propeller for an outboard motor, wherein the propeller has a separate hub and blades that can be easily repaired when damaged, improves fuel efficiency because a lightweight composite material is used therefor, and is easily manufactured in large quantities.

Technical Solution

In order to achieve the object of the present invention, a lightweight composite propeller for an outboard motor includes: a hub having a cylindrical body and having an axial hole at a center; blade cores disposed on an outer side of the hub; a rubber bushing disposed in the hole of the hub; and a circular ring-shaped cap disposed at a front end of the hub to prevent the blade cores from being pulled out forward from the hub, in which the blade cores are each an assembly of a blade and a core, and the core is formed by integrally coupling in advance a portion of a body which forms the outer side of the hub to a lower end of the blade, and has a structure for combining and separating the hub and the blade core.

Advantageous Effects

According to the present invention, when the propeller for an outboard motor is damaged, the hub, the blades, and the rubber bushing can be easily replaced, whereby repair cost and time can be reduced. Further, the weight of the product is reduced by using a composite material, so it is possible to improve fuel efficiency and manufacture the product in large quantities.

REFERENCE NUMERALS

10: Hub
**10*a***: Fitting projection
**10*a*-1**: Flange
**10*a*-2**: Recession
11: Stopper flange
12: Hole
20: Blade core
21: Blade
22: Core
**22*a***: Fitting groove
**22*a*-1**: Bending portion
**22*a*-2**: Fitting portion
30: Rubber bushing
40: Cap

BEST MODE

The present invention is described hereafter in detail with reference to the accompanying drawings.

Figure 1:
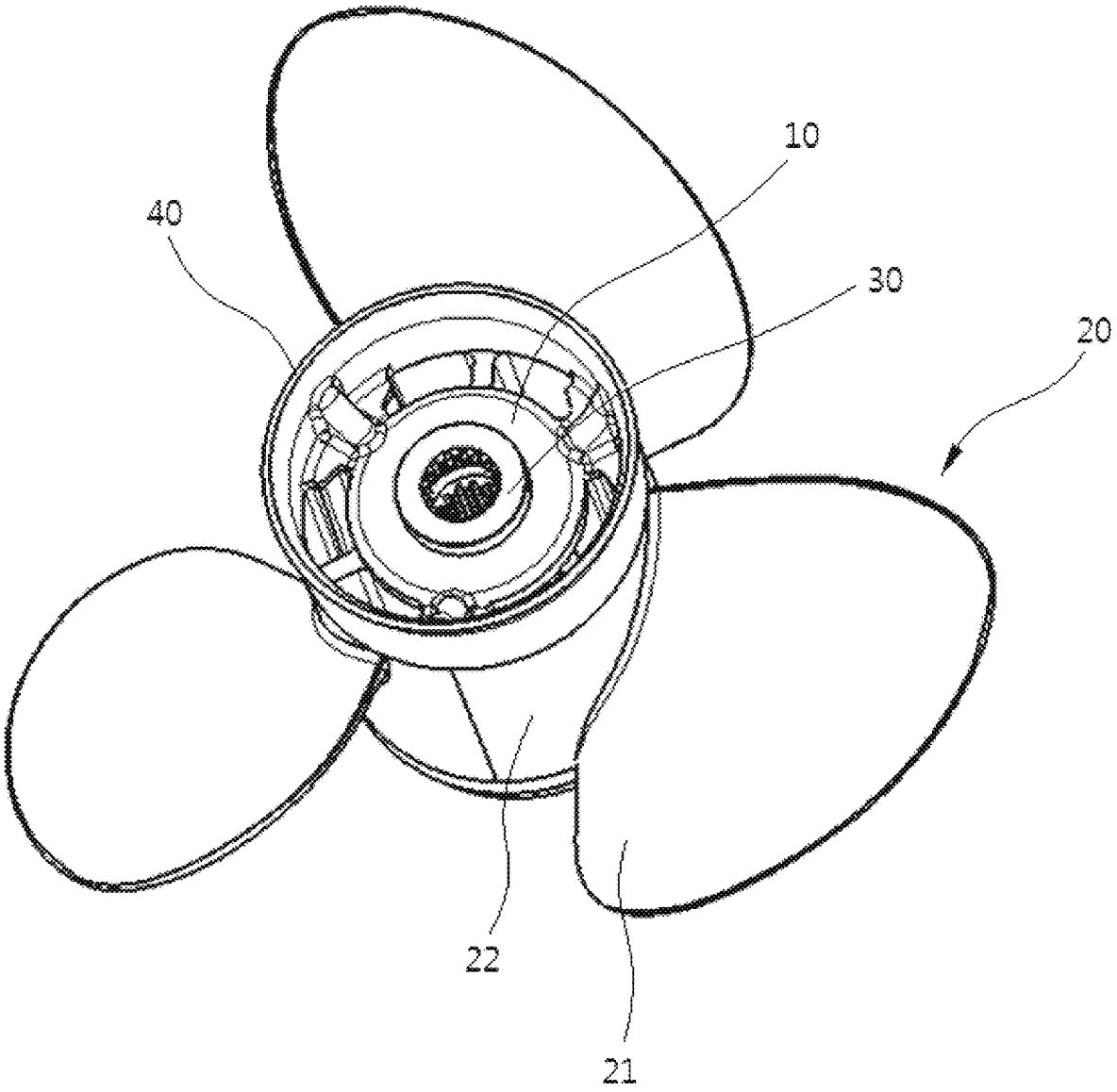
FIG. 1 is an assembly view of a lightweight composite propeller for an outboard motor according to the present invention.
Figure 2:
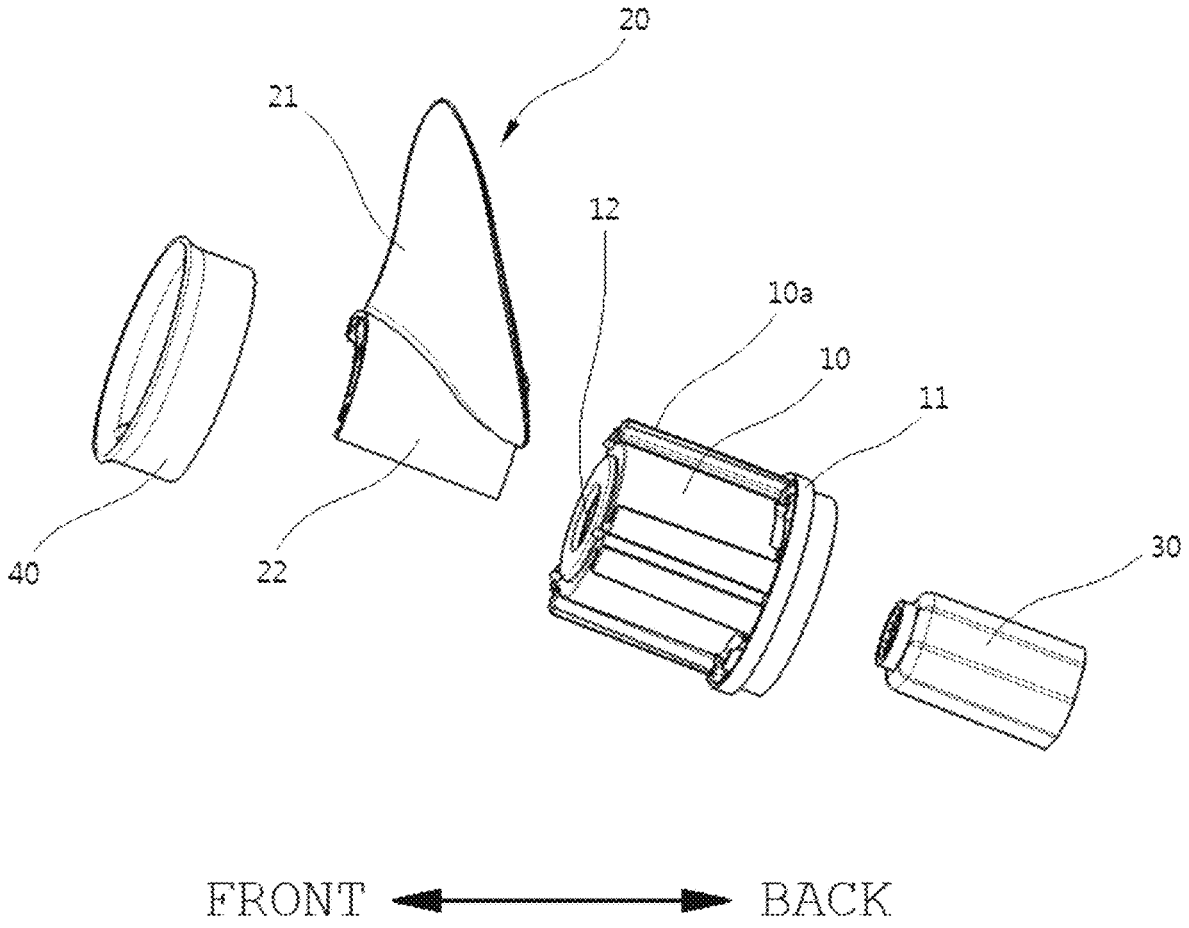
FIG. 2 is an exploded view of the lightweight composite propeller for an outboard motor according to the present invention.

An important characteristic of the present invention is that a hub 10 and blades 21 of a propeller for an outboard motor are separated. FIGS. 1 and 2 are an assembly view and an exploded view of the present invention, respectively.

The hub 10 is coupled to a shaft (not shown) and the blades 21 are combined with the hub 10. When the shaft is rotated by operating an engine, the hub 10 coupled to the shaft is rotated. Accordingly, the blades 21 combined with the hub 10 are rotated, thereby generating thrust. In combination of the blades 21 and the hub 10, the hub 10 and the blades 21 are integrally formed in common propellers, so it is difficult to separate later the blades 21 from the hub 10. However, the blades 21 and the hub 10 are seperably formed in the present invention. The assembly of a blade 21 and the hub 10 can be seen from FIG. 3, and the hub 10 and blade 21 separated from each other can be seen from FIGS. 4 and 5, respectively.

The separable structure of the blades 21 and the hub 10 is described in detail hereafter. First, a specific separable structure called a 'blade core' 20 (FIG. 5) is employed to separate and combine the hub 10 and the blades in the present invention. The blade core 20 is an assembly of a blade 21 and a core 22. The core 22 is formed by integrally coupling in advance a portion of a body which forms the outer side of the hub 10 to the lower end of a blade 21, so the blade 21 can be combined with and separated from the hub 10 by the core 22. When the blade core 20 is fitted on the hub 10, the core 22 of the blade core 20 covers the outer side of the hub 10 in close contact with the outer side, so this assembly substantially functions as the hub 10 in terms of the external shape (FIGS. 1 and 3).

Figure 3:
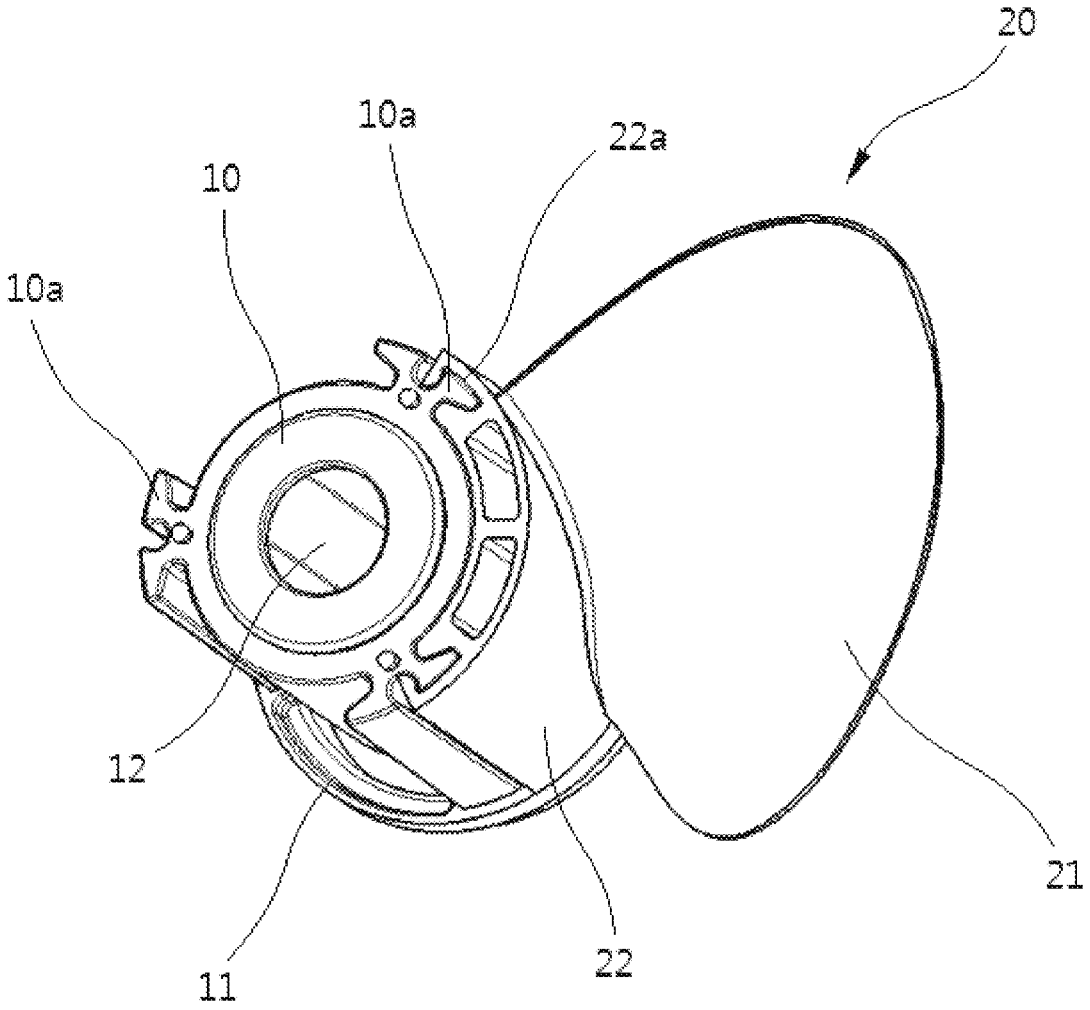
FIG. 3 is an assembly view of a blade core and a hub according to the present invention.
Figure 4:
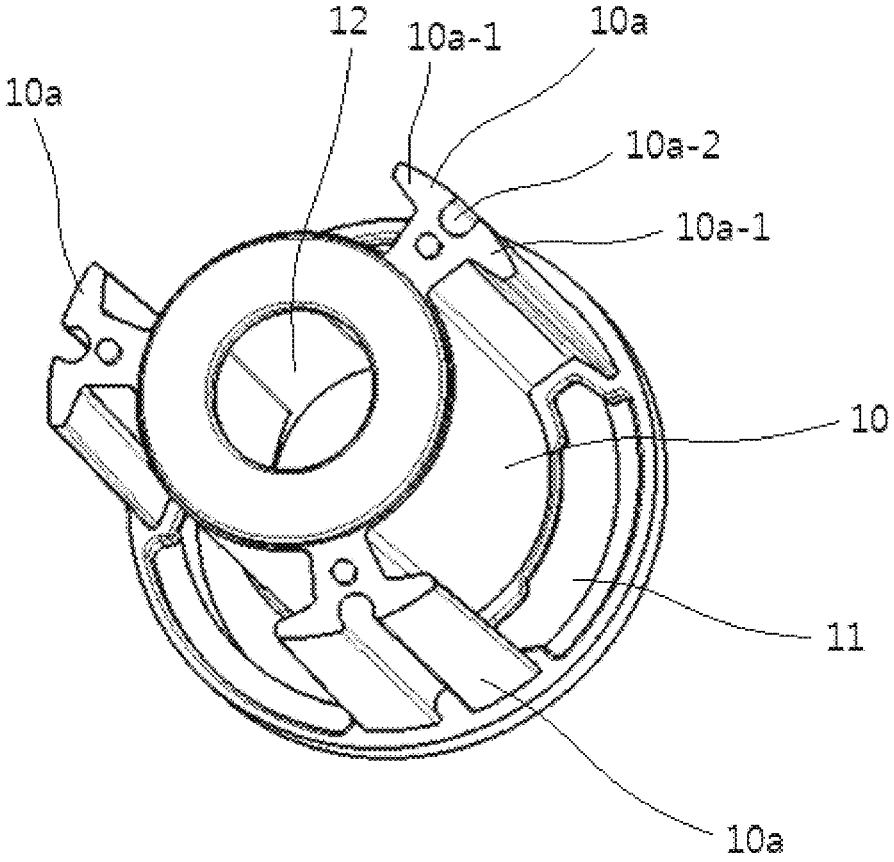
FIG. 4 is a view showing the hub according to the present invention.
Figure 5:
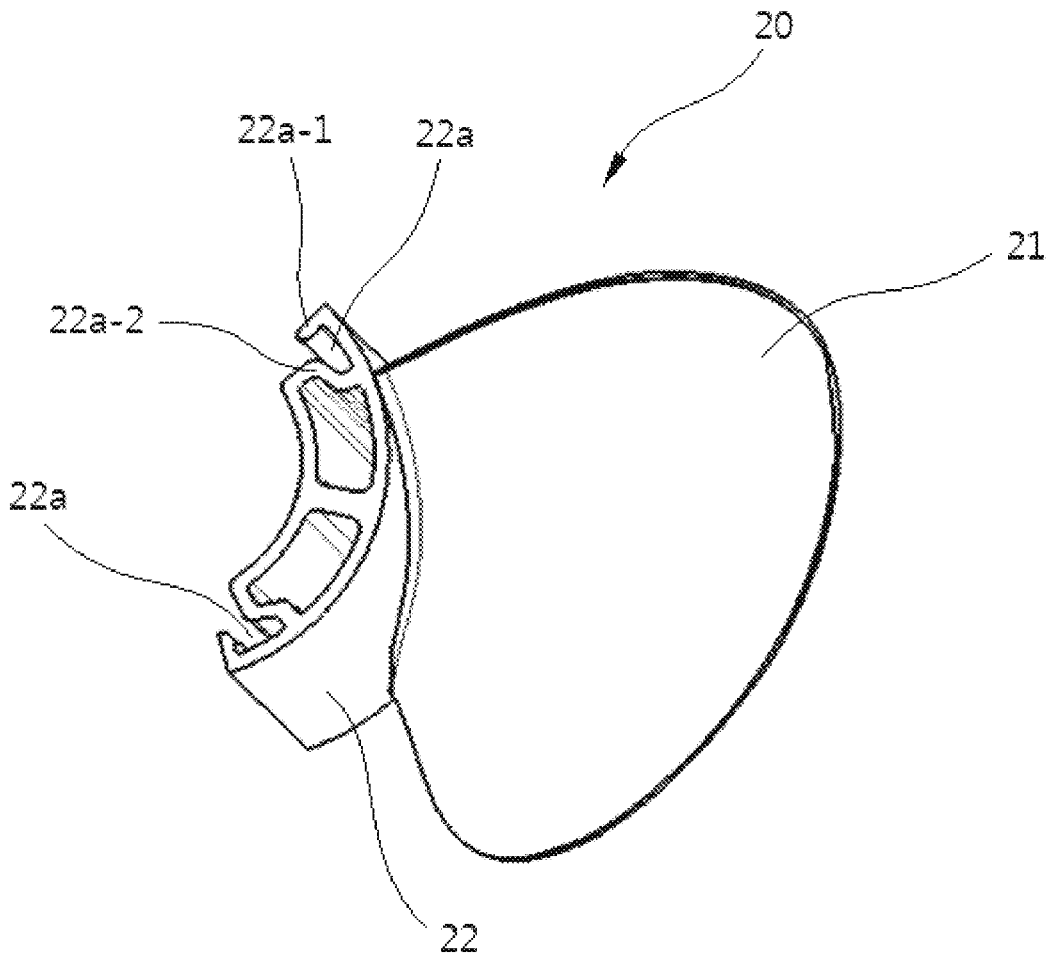
FIG. 5 is a view showing the blade core according to the present invention.

It is possible to combine or separate the blade 21 and the hub 10 by fitting and separating the blade core 20 on and from the hub 10 (FIGS. 2 and 3). To this end, the core 22 has fitting grooves 22*a* to be coupled to the hub 10 (FIGS. 3 and 5). The fitting grooves 22*a* have a U-shaped cross-section and are formed axially straight. In order to correspond to this structure, the hub 10 has fitting projections 10*a* formed with regular intervals around the outer side of the cylindrical body (FIGS. 3 and 4). The fitting projections 10*a* have a T-shaped cross-section and are formed axially straight. Accordingly, the blade core 20 is combined with the hub 10 by pushing backward the blade core 20 with the fitting projections 10*a* partially fitted in the rear ends of the fitting grooves 22*a* (FIG. 2). Obviously, when the blade core 20 is pulled forward in this state, the blade core 20 is pulled off and separated from the hub 10 (FIG. 20). In this case, since the fitting grooves 22*a* and the fitting projections 10*a* are both formed axially straight, it is possible to simply fit and pull the blade core 20 onto and out of the hub 10 only by straightly pushing or pulling the blade core 20.

Meanwhile, the width of the fitting grooves 22*a* gradually decreases as it goes to the center of the shaft (FIGS. 3 and 5), and the width of the fitting projections 10*a* gradually decreases as it goes to the center of the shaft (FIGS. 3 and 4). Accordingly, one the blade core 20 is fitted on the hub 10, the blade core 20 cannot be circumferentially separated (FIG. 3). Therefore, even if a large force (centrifugal force) is circumferentially applied to the blade core 20 when the propeller is rotated, the blade core 20 can remain combined with the hub 10 against the force.

The detailed structures of the fitting grooves 20*a* and the fitting projections 10*a* are as follows. A bending portion 22*a*-1 is formed at a first side of each of the fitting grooves 22*a* by bending both ends of the core 22 toward the center of the shaft and a fitting portion 22*a*-2 extending toward the center of the shaft is formed at a second side of each of the fitting grooves 22*a* to face the bending portion 22*a*-1 with the fitting grooves 22*a* therebetween (FIG. 5). The fitting projections 10*a* each have flanges 10*a*-1 at both sides on the top and a recession 10*a*-2 formed between the flanges 10*a*-1 at both sides (FIG. 4). When the fitting groove 22*a* and the fitting projection 10*a* are fitted, the bending portion 22*a*-1 is fitted in the left or right half of the recession 10*a*-2 and the fitting portion 22*a*-2 is fitted on any one of the flanges 10*a*-1 to cover the flange 10*a*-1 (FIG. 3). Accordingly, fitting groove 22*a* is supported at two positions of the left and right sides on the flange 10*a*-1, which has the following important technical meaning. Referring to FIG. 1, three blade cores 20 are fitted on the hub 10 to form one complete propeller. The propeller is repeatedly rotated clockwise (forward movement) and counterclockwise (backward movement) while a vessel is sailing, so clockwise or counterclockwise force is also repeatedly applied to the blade cores 20. Accordingly, there is a problem in that a gap may be generated between the blade cores 20 in this process, and accordingly, vibration and noise by the propeller may be generated or increased. This may be considered in a sense as an avoidable technical limit of the propeller having the separable structure of the blades 21 and the hub 10. However, the present invention solved this problem through the structure in which a fitting groove 22*a* is supported at left and right positions on a flange 10*a*-1. Referring to FIG. 1, the fitting grooves 22*a* at both ends of the cores 22 of three blade cores 20 are fitted on the fitting projections 10*a* to assembly a propeller, in which two bending portions 22*a*-1 are fitted in contact with each other in the left and right halves of the recession 10*a*-2 of each of the fitting projections 10*a*. In this status, the flanges 10*a*-1 hold the blade cores 20 such that the blade cores 20 are not biased to one side when the propeller is rotated clockwise or counterclockwise. That is, when the propeller is rotated clockwise or counterclockwise, the bending portion 22*a*-1 and the fitting portion 22*a*-2 being in contact with both sides of the flange 10*a*-1 are alternately retained on the flange 10*a*-1 so that the blade core 20 is not biased to a side. Accordingly, even though the propeller is repeatedly rotated clockwise or counterclockwise, a gap is not generated between the blade cores 20, in detail, between the bending portions 22*a*-1 being in contact with each other.

This is a very important matter in a separable device (product) like the present invention. This is because although a separable device is manufactured to be separable, if the device is easily disassembled after assembled, it may be critically defective in terms of firmness and durability. However, the coupling structure of the fitting grooves 22*a* and the fitting projections 10*a* is configured as described above in the present invention so that the blade cores 20 and the hub 10 can be easily separated, but once they are combined, they are not easily disassembled.

Meanwhile, since the fitting groove 22*a* is covered with the bending portion 22*a*-1, the fitting portion 22*a*-2, and the core 22 at the first side, the second side, and the top, respectively, the fitting projections 10*a* are hidden not to be exposed to the outer side by the cores 22 when the propeller is assembled. Therefore, according to the present invention, it is possible to prevent damage to the fitting projections 10*a*, that is, the hub 10 in a broad sense. That is, the propeller frequently hits against objects under water while a vessel is sailed, so if an object directly hits against a fitting projection 10*a* and the fitting projection 10*a* is damaged or broken, the entire hub 10 should be replaced. Obviously, repairing is difficult and costs a lot of money in this case. However, according to the present invention, since the fitting projections 10*a* are not exposed to the outside and the parts that may hit against floating object in water are limited not to the fitting projections 10*a* or the hub 10, but only to the blade cores 20. Accordingly, if a blade core 20 is damaged or broken by hitting against an object under water, it is possible to simply repair the propeller by replacing only the blade core 20. As described above, the present invention has a considerable advantage even in terms of maintenance.

A stopper step 11 is formed at the rear end of the hub 10 (FIGS. 3 and 4). The stopping flange 11 protrudes around the hub 10 and prevents the blade cores 20 fitted on the hub 10 from being pulled out backward from the hub 10 (FIG. 2).

A circular ring-shaped cap 40 is fitted on the front end of the hub 10 after the blade cores 20 are fitted on the hub 10 (FIGS. 1 and 2). Accordingly, the blade cores 20 are prevented from being pulled out forward from the hub 10. The cap 40 may be fixed to the hub 10 by bolts. According to the present invention, as described above, it is possible to very firmly combine the blade cores 20 and the hub 10 and increase the durability of the product through the coupling structure of the fitting grooves 22*a* and the fitting projections 10*a*, the stopping flange 11, and the cap 40. In order to disassemble the propeller of the present invention, a worker has only to separate the cap 40 first.

Since expensive non-metal is used to maximize the anti-corrosion and strength of existing propellers for an outboard motor in the related art, the propellers are heavy and difficult to manufacture in large quantities through precision casing. For this reason, the hub 10 is made of aluminum and, the blade cores 20 and the cap 40 are made of a composite material in the present invention, thereby securing anticorrosion and strength of the product and reducing the weight. In particular, the blade cores 20 and the cap 40 are manufactured by injection-molding a composite material so that the product can be manufactured in large quantities and the manufacturing cost can be reduced.

An axial hole 12 is formed through the center of the hub 10 and a rubber bushing 30 is disposed in the hole 12 (FIGS. 2 and 4). The rubber bushing 30 is fitted on the shaft inside the hub 10 to attenuate a shock that is applied to the shaft, but the rubber bushing 30 may burst when excessive external force is applied. In this case, the rubber bushing 30 should be replaced with new one. However, when the rubber bushing 30 is too tightly fitted in the hub 10 not to be easily pulled out, if the rubber bushing 30 bursts while the vessel is in use, it is impossible to manually replace the rubber bushing 30, which causes a difficult situation.

Accordingly, the rubber bushing 30 in the present invention is designed to have an appropriate size so that it can be easily replaced by a person, that is, the diameter of the rubber bushing 30 may be designed to be 5 to 10 mm smaller than the diameter of the hole 12. In this case, since the rubber bushing 30 is made of rubber, it is sufficiently possible for a person to reduce the diameter of the rubber bushing 30 by 5 to 10 mm when pushing the rubber bushing 30 into the hole 12. The rubber bushing 30 inserted in the hole 12 is close contact with the hole 12 due to the elasticity of rubber, so it is tightly fitted in the hub 10. In contrast, it is also sufficiently possible to manually pull out the rubber bushing 30 in order to replace the rubber bushing 30.

As described above, according to the present invention, when the propeller for an outboard motor is damaged, the hub 10, the blades 21, and the rubber bushing 30 can be easily replaced, so repairing requires less cost and time. Further, the weight of the product is reduced by using a composite material, so it is possible to improve fuel efficiency and manufacture the product in large quantities.

INDUSTRIAL APPLICABILITY

According to the present invention, repairing takes less cost and time when the propeller for an outboard is damaged, fuel efficiency can be improved by using a composite material, and the propeller can be manufactured in large quantities. Therefore, the present invention can achieve practical and economic values through wide use in shipbuilding and marine engineering fields.

The invention claimed is:

1. A lightweight composite propeller for an outboard motor, the propeller comprising:

a hub (10) having a cylindrical body and having an axial hole (12) at a center;

blade cores (20) disposed on an outer side of the hub (10);

a rubber bushing (30) disposed in the hole (12) of the hub (10); and a circular ring-shaped cap (40) disposed at a front end of the hub (10) to prevent the blade cores (20) from being pulled out forward from the hub (10), wherein the blade cores (20) are each an assembly of a blade (21) and a core (22), the core (22) is formed by integrally coupling in advance a portion of a body which forms the outer side of the hub (10) to a lower end of the blade (21), and has a structure for combining and separating the hub (10) and the blade core (20), the core (22) has fitting grooves (22*a*) having a U-shaped cross-section and formed axially straight and the hub (10) has fitting projections (10*a*) formed axially straight, having a U-shaped cross-section, and arranged with regular intervals around the outer side, so the hub (10) and the blade core (20) are combined and separated by fitting and pulling the fitting projections (10*a*) into and out of the fitting grooves (22*a*), a bending portion (22*a*-1) is formed at a first side of each of the fitting grooves (22*a*) by bending both ends of the core (22) toward a central axis and a fitting portion (22*a*-2) extending toward the central axis is formed at a second side of each of the fitting grooves (22*a*) to face the bending portion (22*a*-1) with the fitting grooves (22*a*) therebetween, the fitting projections (10*a*) each have flanges (10*a*-1) at both sides on a top and a recession (10*a*-2) formed between the flanges (10*a*-1) at both sides, and when the fitting groove (22*a*) and the fitting projection (10*a*) are fitted, the bending portion (22*a*-1) is fitted in a left or right half of the recession (10*a*-2) and the fitting portion (22*a*-2) is fitted on any one of the flanges (10*a*-1) to cover the flange (10*a*-1).

2. The propeller of claim 1, wherein a width of the fitting grooves (22*a*) gradually decreases as it goes to the central axis, and a width of the fitting projections (10*a*) gradually decreases as it goes to the central axis.

3. The propeller of claim 1, wherein a stopping flange (11) protruding around the hub (10) is formed at a rear end of the hub (10) and prevents the blade cores (20) from being pulled out backward from the hub (10).

4. The propeller of claim 1, wherein the hub (10) is made of aluminum and, the blade cores (20) and the cap (40) are made of a composite material.

5. The propeller of claim 1, wherein the rubber bushing (30) is larger in diameter by 5 to 10 mm than the hole (12).

* * * * *